US007109659B2

(12) United States Patent
Kamoi

(10) Patent No.: US 7,109,659 B2
(45) Date of Patent: Sep. 19, 2006

(54) HIGH-INTENSITY DISCHARGE LAMP BALLAST AND METHOD FOR OPERATING HIGH-INTENSITY DISCHARGE LAMP

(75) Inventor: Takeshi Kamoi, Woburn, MA (US)

(73) Assignee: Matsushita Electric Works, Ltd., Kadoma (JP)

( * ) Notice: Subject to any disclaimer, the term of this patent is extended or adjusted under 35 U.S.C. 154(b) by 162 days.

(21) Appl. No.: 10/991,415

(22) Filed: Nov. 19, 2004

(65) Prior Publication Data

US 2006/0108940 A1 May 25, 2006

(51) Int. Cl.
*H05B 39/10* (2006.01)

(52) U.S. Cl. ..... 315/88; 315/92; 315/291; 315/307; 362/13; 362/20

(58) Field of Classification Search ..... None
See application file for complete search history.

(56) References Cited

U.S. PATENT DOCUMENTS 4,034,259 A * 7/1977 Schoch ..... 315/93
6,426,597 B1 7/2002 Rast et al.
6,448,720 B1 9/2002 Sun
6,489,729 B1 12/2002 Erhardt et al.
6,781,316 B1 * 8/2004 Oda ..... 315/88

* cited by examiner

*Primary Examiner*—Tuyet Thi Vo
(74) *Attorney, Agent, or Firm*—Oblon, Spivak, McClelland, Maier & Neustadt, P.C.

(57) ABSTRACT

A high-intensity discharge lamp ballast includes a lamp operation unit configured to supply power from a power source to a high-intensity discharge lamp, a lamp voltage detector configured to detect a voltage applied to the high-intensity discharge lamp, a lamp status determination unit configured to determine whether the high-intensity discharge lamp is in a turned-on state, based on the voltage detected by the lamp voltage detector, an auxiliary lamp switching element configured to connect the power source and an auxiliary lamp having a rated voltage, and a controller configured to control the auxiliary lamp switching element so as to apply to the auxiliary lamp a voltage substantially equal to the rated voltage of the auxiliary lamp when the high-intensity discharge lamp is supplied with the power and the lamp status determination unit determines that the high-intensity discharge lamp is not in the turned-on state.

20 Claims, 16 Drawing Sheets

HIGH-INTENSITY DISCHARGE LAMP BALLAST AND METHOD FOR OPERATING HIGH-INTENSITY DISCHARGE LAMP

BACKGROUND OF THE INVENTION

1. Field of the Invention

The present invention relates to a high-intensity discharge lamp ballast and a method for operating a high-intensity discharge lamp.

2. Discussion of the Background

A high-intensity discharge lamp is a light source which allows brighter lighting with higher light output and is operated with a device called ballast in order to achieve more steady lighting. There are two types of ballasts: a magnetic ballast composed mainly of inductors, and an electronic ballast having the electronic circuit which provides switching control, and the electronic ballast is more popular these days for the energy-saving objective.

U.S. Pat. No. 6,426,597 discloses an electronic ballast for operating a gas discharge lamp, and this electronic ballast has a circuit arrangement comprised of four switches interconnected to form a full bridge.

Also, U.S. Pat. No. 6,448,720 discloses a discharge lamp driving circuit having a tank circuit and a DC-AC inverter, and the DC-AC inverter has a bridge circuit in which MOSFETs are configured in a full bridge arrangement.

Incidentally, when a driving circuit starts operating a high-intensity discharge lamp, since the temperature and the pressure inside the lamp are still low, the lamp does not generate sufficient light output. When the temperature and the pressure become considerably high, the lamp begins its steady operation, but at this point, if the high-intensity discharge lamp is turned off, it takes time to restart the lamp. For example, it may take several minutes or several tens of minutes until the temperature and the pressure become lower again. Thus, if the high-intensity discharge lamp is switched off due to a blackout, for example, and even if the power gets back immediately after, the lamp may not restart its operation with sufficient light output for several tens of minutes.

U.S. Pat. No. 6,489,729 discloses an auxiliary lighting device which turns on an auxiliary lamp while a high-intensity discharge lamp is turned off. The auxiliary lighting device is provided with an HID lamp status circuit, a phase control circuit, a TRIAC, an auxiliary light source, a rectifier circuit and an amplifier. When the HID lamp status circuit receives a signal indicating that the high-intensity discharge lamp is "OFF", the HID lamp status circuit sends a signal to the phase control circuit to turn on the auxiliary light source. The rectifier circuit and the amplifier form a feedback circuit, and the rectifier circuit outputs a voltage signal having a magnitude of the voltage applied to the auxiliary light source. The amplifier compares the voltage signal with a reference voltage, and outputs to the phase control circuit an error signal representing the difference between the voltage signal and the reference voltage. Based on the error signal, the phase control circuit controls the TRIAC so that a target voltage is applied to the auxiliary light source. However, this auxiliary lighting device requires the detection of the voltage across the auxiliary light source followed by the feedback control based on the detected voltage, and therefore the performance of the auxiliary lighting device may be less efficient, and its circuit structure tends to be more complicated and costly.

The contents of the U.S. Pat. Nos. 6,426,597, 6,448,720 and 6,489,729 are incorporated herein by reference in their entirety.

SUMMARY OF THE INVENTION

According to one aspect of the present invention, a high-intensity discharge lamp ballast includes a lamp operation unit configured to supply power from a power source to a high-intensity discharge lamp, a lamp voltage detector configured to detect a voltage applied to the high-intensity discharge lamp, a lamp status determination unit configured to determine whether the high-intensity discharge lamp is in a turned-on state, based on the voltage detected by the lamp voltage detector, an auxiliary lamp switching element configured to connect the power source and an auxiliary lamp having a rated voltage, and a controller configured to control the auxiliary lamp switching element so as to apply to the auxiliary lamp a voltage substantially equal to the rated voltage of the auxiliary lamp when the high-intensity discharge lamp is supplied with the power and the lamp status determination unit determines that the high-intensity discharge lamp is not in the turned-on state.

According to another aspect of the present invention, a method for operating a high-intensity discharge lamp includes supplying power from a power source to the high-intensity discharge lamp, detecting a voltage applied to the high-intensity discharge lamp, determining whether the high-intensity discharge lamp is in a turned-on state, based on a detected voltage, providing an auxiliary lamp switching element configured to connect the power source and an auxiliary lamp having a rated voltage, and controlling the auxiliary lamp switching element so as to apply to the auxiliary lamp a voltage substantially equal to the rated voltage of the auxiliary lamp when the high-intensity discharge lamp is supplied with the power and the lamp status determination unit determines that the high-intensity discharge lamp is not in the turned-on state.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1A:
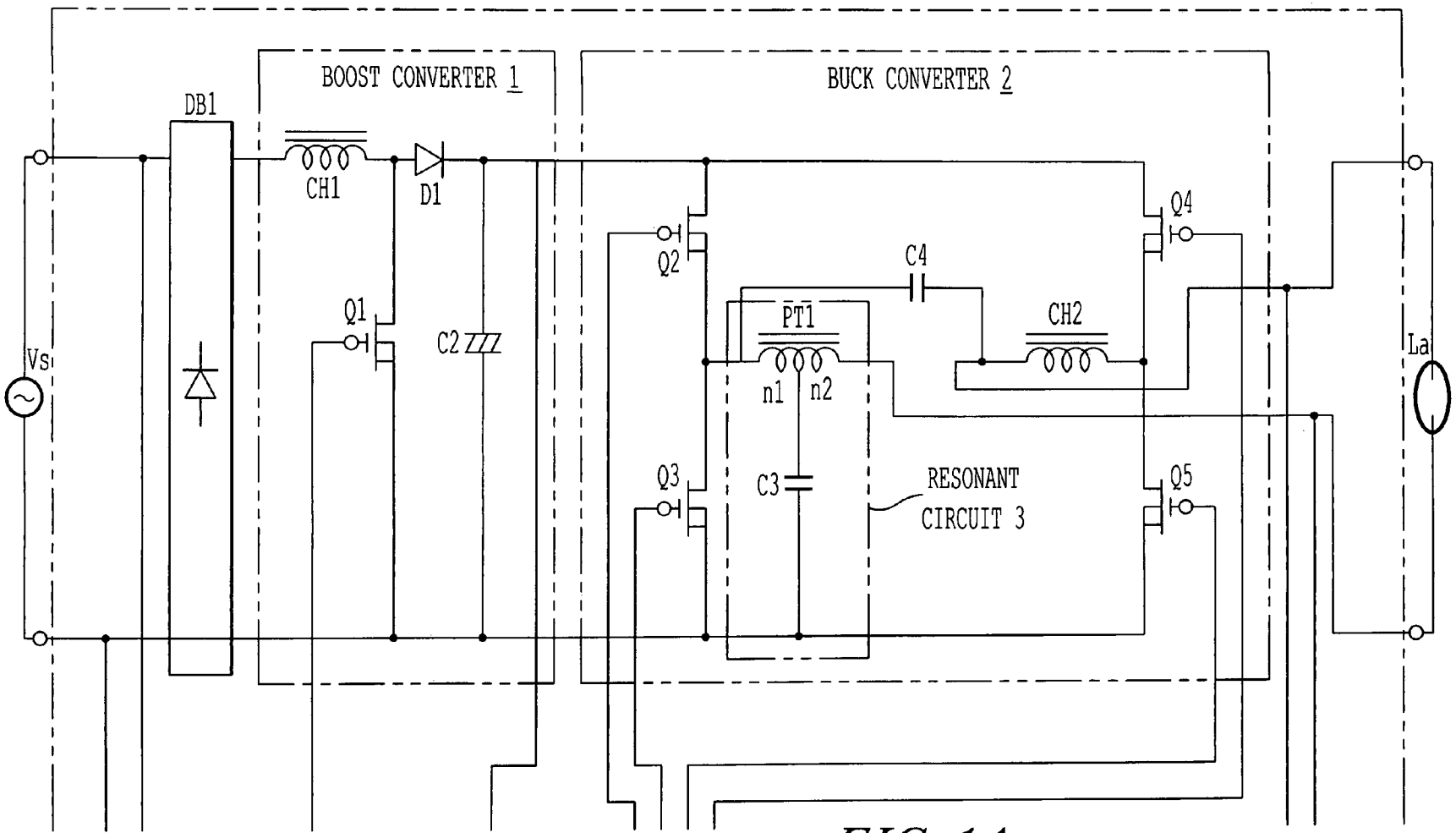
FIGS. 1(*a*) and 1(*b*) are schematic block diagrams illustrating a high-intensity discharge lamp ballast according to a first embodiment of the present invention.

The embodiments will now be described with reference to the accompanying drawings, wherein like reference numerals designate corresponding or identical elements throughout the various drawings.

Figure 1B:
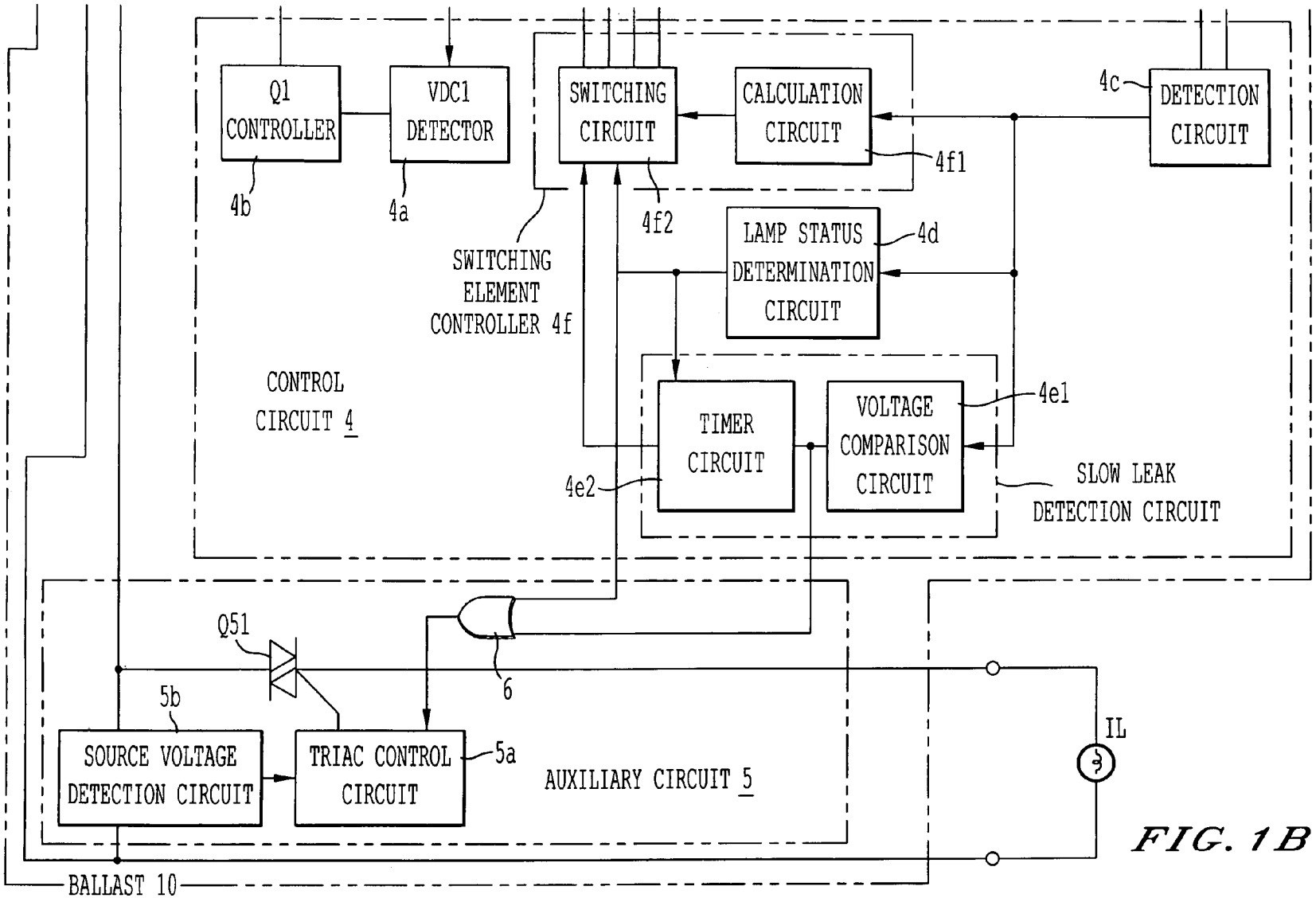

FIGS. 1(*a*) and 1(*b*) are schematic block diagrams showing a high-intensity discharge lamp ballast according to a first embodiment of the present invention. A high-intensity discharge lamp ballast 10 (hereinafter, referred to as "ballast 10") includes a lamp operation circuit 11, a control circuit 4 and an auxiliary circuit 5.

The lamp operation circuit 11 includes a rectifier (DB1), a boost converter 1, and a buck converter 2 of a polarity inversion type. The rectifier (DB1) rectifies an AC voltage supplied from a commercial AC power source (hereinafter, simply referred to as "power source") having a source voltage (Vs). The boost converter 1 includes a switching element (Q1) and converts the voltage from the rectifier (DB1) to a DC voltage (VDC1). Also, the boost converter 1 increases the input power factor and thus prevents the input current distortion. The buck converter 2 includes a resonant circuit 3 and switching elements (Q2)–(Q5), and converts the DC voltage (VDC1) to a square wave AC voltage to be applied to a high-intensity discharge lamp (hereinafter, referred to as "HID lamp") (La). The buck converter 2 has multiple modes of operation, including a starter power mode for starting the operation of the HID lamp (La) and a steady power mode for steadily operating the HID lamp (La). The resonant circuit 3 includes a pulse transformer (PT1) and a capacitor (C3), and the pulse transformer (PT1) has a primary winding (n1) and a secondary winding (n2). Also, the resonant circuit 3 has a resonant frequency (fr) and supplies a resonant step-up voltage applied to the HID lamp (La) for starting or restarting the HID lamp (La).

The control circuit 4 includes a VDC1 detector 4*a*, a Q1 controller 4*b*, a detection circuit 4*c*, a lamp status determination circuit 4*d*, a slow leak detection circuit 4*e*, and a switching element controller 4*f*, and controls the switching elements (Q1)–(Q5). The VDC1 detector 4*a* is configured to detect the output voltage of the boost converter 1. The Q1 controller 4*b* is configured to control the switching element (Q1) based on the output voltage detected by the VDC1 detector 4*a*. The detection circuit 4*c* (lamp voltage detector) is configured to detect a lamp voltage (Vla) applied to the HID lamp (La). The lamp status determination circuit 4*d* (lamp status determination unit) is configured to determine whether the HID lamp (La) is in a turned-on state in which the HID lamp (La) generates light, based on the lamp voltage (Vla) detected by the detection circuit 4*c*. The slow leak detection circuit 4*e* (slow leak detector) includes a voltage comparison circuit 4*e*1 and a timer circuit 4*e*2, and is configured to detect a slow leak in the HID lamp (La). The HID lamp (La) contains an arc tube filled with gas, but a small amount of gas may leak from the arc tube. Here, a slow leak refers to a condition where the lamp voltage (Vla) across the HID lamp (La) does not reach the rated voltage of the lamp due to such a small amount of gas leakage. The voltage comparison circuit 4*e*1 (lamp voltage comparator) is configured to compare the lamp voltage (Vla) with a predetermined threshold voltage (Vsl). The slow leak detection circuit 4*e* determines that there is a slow leak when the lamp voltage (Vla) remains lower than the threshold voltage (Vsl) for a period of time exceeding a predetermined length of time, and sends a signal to the switching element controller 4*f* so as to stop the operation of the ballast 10. Accordingly, the slow leak detection circuit 4*e* prevents the abnormal temperature increase in the ballast 10 when the slow leak occurs and the HID lamp (La) remains turned on with a low lamp voltage and a large lamp current. The switching element controller 4*f* includes a calculation circuit 4*f*1 and a switching circuit 4*f*2. The calculation circuit 4*f*1 is configured to determine the frequencies and the lengths of "ON" periods of the switching elements (Q4) and (Q5), based on the lamp voltage (Vla) detected by the detection circuit 4*c*. The switching circuit 4*f*2 is configured to switch the modes of the buck converter 2 between the starter power mode and the steady power mode. When the buck converter 2 is operating in the steady power mode, the switching elements (Q2)–(Q5) are controlled by the signals output from the calculation circuit 4*f*1 through the switching circuit 4*f*2.

The auxiliary circuit 5 includes a TRIAC (Q51), a TRIAC control circuit (5*a*), a source voltage detection circuit 5*b* (source voltage detector, voltage comparison unit) and an OR circuit 6, and has a terminal to which an auxiliary lamp (IL) is connected. The auxiliary lamp (IL) may be an incandescent lamp, a halogen lamp or other lamps. The TRIAC (Q51) is a bidirectional gate-controlled switching element connected between the power source and the terminal for the auxiliary lamp (IL). The source voltage detection circuit 5*b* detects the source voltage (Vs) of the power source and compares the detected voltage with a predetermined reference voltage (Vsv), and outputs the comparison result to the TRIAC control circuit 5*a* which controls the TRIAC (Q51) accordingly.

Referring to FIGS. 1(*a*) and 1(*b*), the operation of the ballast 10 is described below.

The lamp operation circuit 11 receives the AC voltage from the power source, and the voltage rectified by the rectifier (DB1) is input to the boost converter 1. Based on the DC voltage (VDC1) output from the boost converter 1, the control circuit 4 switches on and off the switching element (Q1) at a frequency of several tens of kHz so that the DC voltage (VDC1) becomes a predetermined voltage (Va) while the HID lamp (La) is turned on or off. When the voltage (Va) becomes the predetermined voltage (Va), the buck converter 2 starts operating in the starter power mode. At this point, the HID lamp (La) is turned off and its equivalent impedance is almost infinite as the open condition. In the starter power mode of the buck converter 2, a first period when the switching elements (Q2) and (Q5) are "ON" and a second period when the switching elements (Q3) and (Q4) are "ON" are alternately repeated at a predetermined frequency (f0). The frequency (f0) is, for example, about several hundreds of kHz. The frequency (f0) is set close to the resonant frequency (fr), and a sine wave high voltage is produced in the primary winding (n1). This high voltage is increased by the primary/secondary winding ratio of the pulse transformer (PT1) and supplied to the HID lamp (La) through the capacitor (C4), and as a result of dielectric breakdown, the HID lamp (La) starts operating. When the HID lamp (La) starts its operation, its impedance becomes lower as a short circuit condition, and the lamp voltage (Vla) across the HID lamp (La) becomes approximately 0 V. The lamp status determination circuit 4*d* determines whether the HID lamp (La) is turned on or off, based on the lamp voltage (Vla) detected by the detection circuit 4*c*. More specifically, while the HID lamp (La) is off, the lamp status determination circuit 4*d* outputs an H signal, but when the HID lamp (La) is switched on and thus the lamp voltage (Vla) becomes lower than a threshold voltage (lamp status determination threshold voltage (Vst) shown in FIG. 2), the lamp status determination circuit 4*d* determines that the HID lamp (La) is turned on and outputs an L signal to the switching circuit 4*f*2 of the switching element controller 4*f*. The switching circuit 4*f*2 then switches the buck converter 2 to the steady power mode for operating the HID lamp (La) with a steady light output. In this mode, the switching elements (Q2) and (Q3) are alternately turned on at a predetermined frequency (fa). While the switching element (Q2) is on, the switching element (Q5) is turned on and off at a preset frequency (fb), and while the switching element (Q3) is on, the switching element (Q4) is turned on and off at the preset frequency (fb). The frequency (fa) is, for example, about several hundreds of Hz, and the frequency (fb) is, for example, about several tens of kHz. As a result, the HID lamp (La) receives a square wave AC voltage with the frequency (fa). The lamp voltage (Vla) across the HID lamp (La) is still low immediately after its start of operation, but as the inside temperature and pressure of the HID lamp (La) becomes higher, the lamp voltage (Vla) is increased, and then the HID lamp (La) reaches the steady operation at its rated voltage. Based on the lamp voltage (Vla) detected by the detection circuit 4*c*, the calculation circuit 4*f*1 determines the frequencies and the lengths of the ON periods of the switching elements (Q4) and (Q5) so as to supply appropriate power to the HID lamp (La), and according to the determined frequencies and the lengths, the switching circuit 4*f*2 switches on and off the switching elements (Q4) and (Q5), thereby operating the HID lamp (La) steadily.

Figure 2:
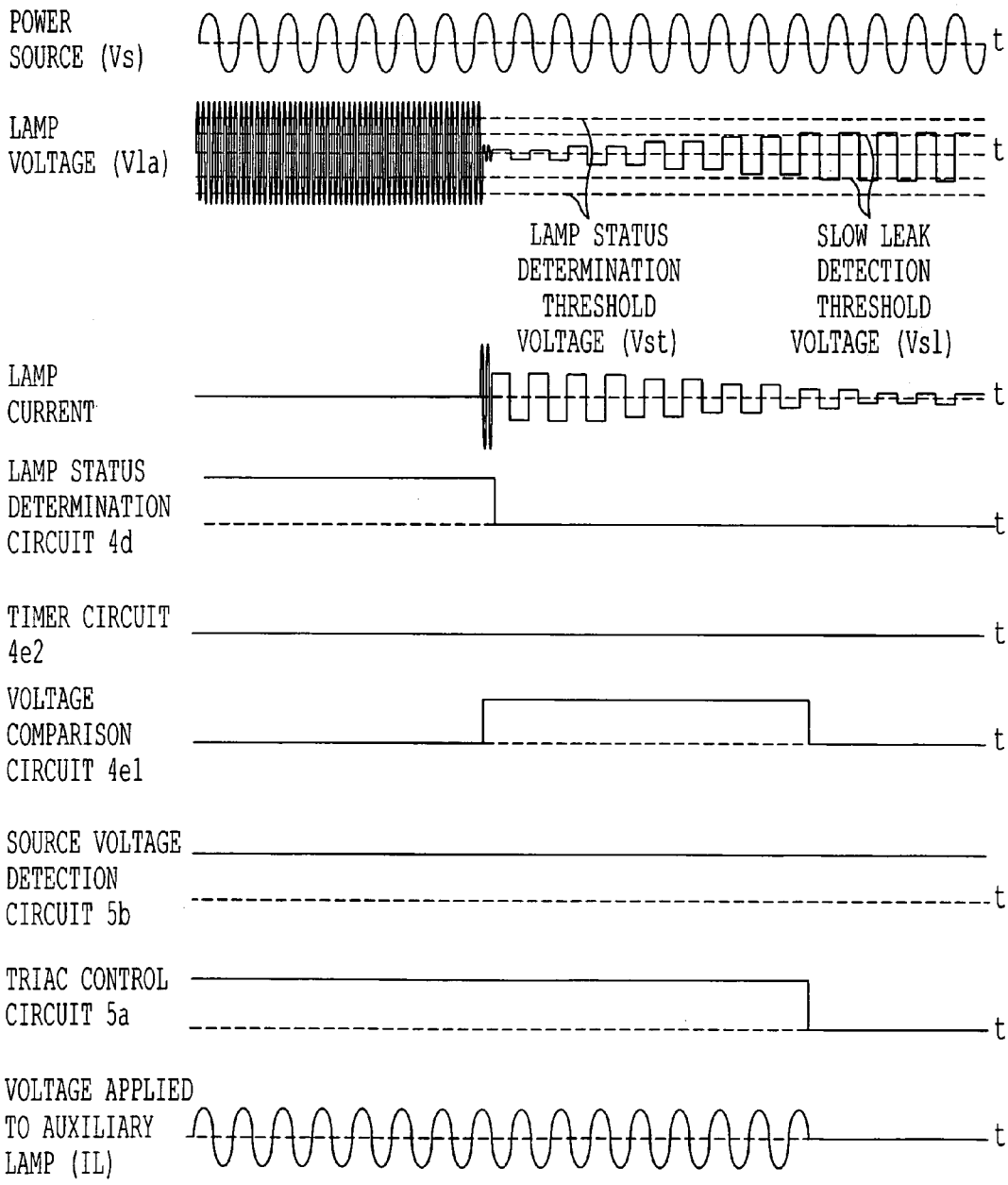
FIG. 2 is a sequence diagram showing an operation of the high-intensity discharge lamp ballast when the source voltage is not higher than the rated voltage of the auxiliary lamp.

FIG. 2 is a sequence diagram showing the operation of the ballast 10 in the case where the source voltage (Vs) of the power source is substantially equal to the rated voltage of the auxiliary lamp (IL). FIG. 2 shows, from the top to the bottom, the source voltage (Vs) of the power source, the lamp voltage (Vla), the lamp current flowing through the HID lamp (La), the outputs of the lamp status determination circuit 4*d*, the timer circuit 4*e*2, the voltage comparison circuit 4*e*1, the source voltage detection circuit 5*b*, and the TRIAC control circuit 5*a*, and the voltage applied to the auxiliary lamp (IL). As shown in FIG. 2, the HID lamp (La) is at first "OFF", receiving a high voltage with a high frequency, for example, about several hundreds of kHz, and the buck converter 2 is operating in the starter power mode. At this point, the lamp status determination circuit 4*d* outputs an H signal which indicates that the HID lamp (La) is turned off. The source voltage detection circuit 5*b* detects the source voltage (Vs) and compares the detected voltage with the predetermined reference voltage (Vsv). In this case, since the detected voltage is smaller than the reference voltage (Vsv), the source voltage detection circuit 5*b* outputs an H signal to the TRIAC control circuit 5*a*, and the TRIAC control circuit 5*a* forms a DC signal as a gate signal for the TRIAC (Q51). The H signal indicating the "OFF" status of the HID lamp (La) produced by the lamp status determination circuit 4*d* is input to the OR circuit 6 in the auxiliary circuit 5, and based on this H signal, the TRIAC control circuit 5*a* supplies the DC signal to the TRIAC (Q51). The DC signal turns on the TRIAC (Q51), and the auxiliary lamp (IL) receives a voltage substantially equal to the source voltage (Vs). After receiving the high voltage with a high frequency for a certain period of time, the HID lamp (La) is started, and the lamp voltage (Vla) is decreased. The lamp status determination circuit 4*d* compares the detected lamp voltage (Vla) with a predetermined threshold voltage (Vst), and when the detected lamp voltage (Vla) is lower than the threshold value, the lamp status determination circuit 4*d* determines that the HID lamp (La) is turned on, and switches its output from the H signal to the L signal. Upon receiving this L signal, the buck converter 2 changes the operation mode from the starter power mode to the steady power mode. The voltage comparison circuit 4*e*1 of the slow leak detection circuit 4*e* outputs an L signal until the HID lamp (La) starts operating. When the HID lamp (La) is turned on, and the lamp voltage (Vla) is lowered than the slow leak detection threshold voltage (Vsl), the voltage comparison circuit 4*e*1 switches the output from the L signal to an H signal. Upon the receipt of the H signal, the timer circuit 4*e*2 starts measuring the time. The H signal from the voltage comparison circuit 4*e*1 is input to the OR circuit 6, and the TRIAC control circuit 5*a* supplies the DC signal as the gate signal to the TRIAC (Q51). The TRIAC (Q51) is turned on, and the voltage substantially equal to the source voltage (Vs) remains being applied to the auxiliary lamp (IL). After the buck converter 2 starts operating in the steady power mode and the lamp voltage (Vla) across the HID lamp (La) exceeds the threshold voltage (Vsl) as shown in FIG. 2, the voltage comparison circuit 4*e*1 switches the output from the H signal to the L signal, and since the OR circuit 6 receives the L signal from both the lamp status determination circuit 4*d* and the voltage comparison circuit 4*e*1, the TRIAC control circuit 5 a stops supplying the gate signal to the TRIAC (Q51) to turn off the TRIAC (Q51). As a result, the power supply to the auxiliary lamp (IL) is stopped, and thus the auxiliary lamp (IL) is turned off.

Figure 3:
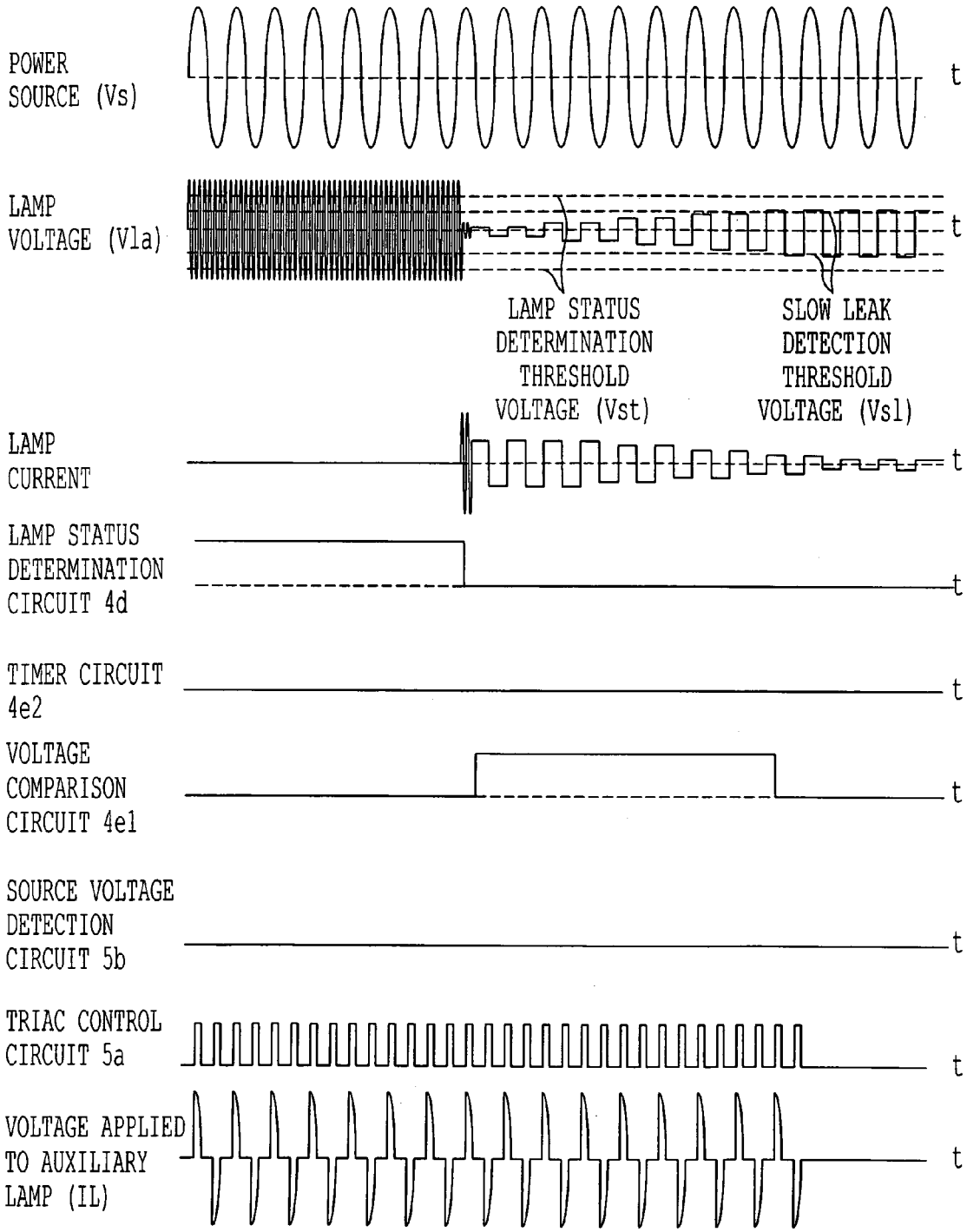
FIG. 3 is a sequence diagram showing an operation of the high-intensity discharge lamp ballast when the source voltage is higher than the rated voltage of the auxiliary lamp.

When the source voltage (Vs) of the power source is higher than the rated voltage of the auxiliary lamp (IL), the ballast 10 operates in a different manner. FIG. 3 is a sequence diagram showing the operation of the ballast 10 in the case where the source voltage (Vs) of the power source is higher than the rated voltage of the auxiliary lamp (IL). Unlike FIG. 2, the source voltage detection circuit 5*b* outputs an L signal indicating that the detected source voltage is higher than a predetermined reference voltage (Vsv). Based on this L signal, the TRIAC control circuit 5*a* forms a pulse of a fixed width as a gate signal supplied to the TRIAC (Q51) for a phase control of the source voltage at a fixed phase. While the HID lamp (La) is turned off, the lamp status determination circuit 4*d* produces an H signal to the OR circuit 6, and thus the TRIAC control circuit 5*a* supplies the pulse to the TRIAC (Q51) and turns on/off the TRIAC (Q51) at fixed phases so as to apply to the auxiliary lamp (IL) a voltage substantially equal to the rated voltage of the auxiliary lamp (IL). Regarding the predetermined reference voltage (Vsv) which the source voltage detection circuit 5*b* uses for determine whether the source voltage (Vs) is higher than the rated voltage of the auxiliary lamp (IL), the reference voltage (Vsv) may be an allowable maximum voltage of the power source having a source voltage substantially equal to the rated voltage of the auxiliary lamp (IL). For example, in the case of the AC voltage of 120 V, the voltage may fluctuate in the rage of from about 108 V to about 132 V, and the allowable maximum voltage is about 132 V. In view of such a fluctuation of the source voltage, the reference voltage (Vsv) may be about 10% larger than the source voltage substantially equal to the rated voltage of the auxiliary lamp. Alternatively, the reference voltage (Vsv) may be an allowable maximum voltage of the rated voltage of the auxiliary lamp (IL). For example, for the auxiliary lamp (IL)

having the rated voltage of 120 V, the allowable maximum voltage is about 140 V. In this case, since the reference voltage (Vsv) is sufficiently higher than the source voltage even if it fluctuates, the source voltage detection circuit 5*b* determines whether or not the source voltage is higher than the rated voltage of the auxiliary lamp (IL) more accurately, and thus the auxiliary circuit 5 operates the auxiliary lamp (IL) more properly without damaging the auxiliary lamp (IL) with a high voltage. Also, since the reference voltage (Vsv) is desirably set as above in consideration of the fluctuation of the source voltage, when the reference voltage (Vsv) is set as, for instance, 140 V, for the auxiliary lamp (IL) with the rated voltage of 120 V, and the source voltage (Vs) fluctuates but does not exceed the reference voltage (Vsv), the source voltage (Vs) is not phase-controlled to apply a reduced voltage to the auxiliary lamp (IL). Thus, the auxiliary lamp (IL) produces a sufficient light output, receiving a higher voltage within the allowable voltage range for the auxiliary lamp (IL).

After the HID lamp (La) is turned on, the operation of the ballast 11 is similar to the case in FIG. 2. As shown in FIG. 3, until the lamp voltage (Vla) reaches the leak threshold value (Vsl), the voltage comparison circuit 4*e*1 outputs an H signal to the OR circuit 6, and thus TRIAC control circuit 5*a* supplies the DC signal to turn on the TRIAC (Q51). While the HID lamp (La) is operated in the steady power mode and when the lamp voltage (Vla) exceeds the leak threshold value (Vsl), the voltage comparison circuit 4*e*1 switches the output from the H signal to the L signal. Based on the L signals input from the lamp status determination circuit 4*d* and the voltage comparison circuit 4*e*1, the TRIAC control circuit 5*a* stops supplying the gate signal to the TRIAC (Q51) to turn off the TRIAC (Q51). As a result, the power supply to the auxiliary lamp (IL) is stopped, and thus the auxiliary lamp (IL) is turned off.

Figure 4:
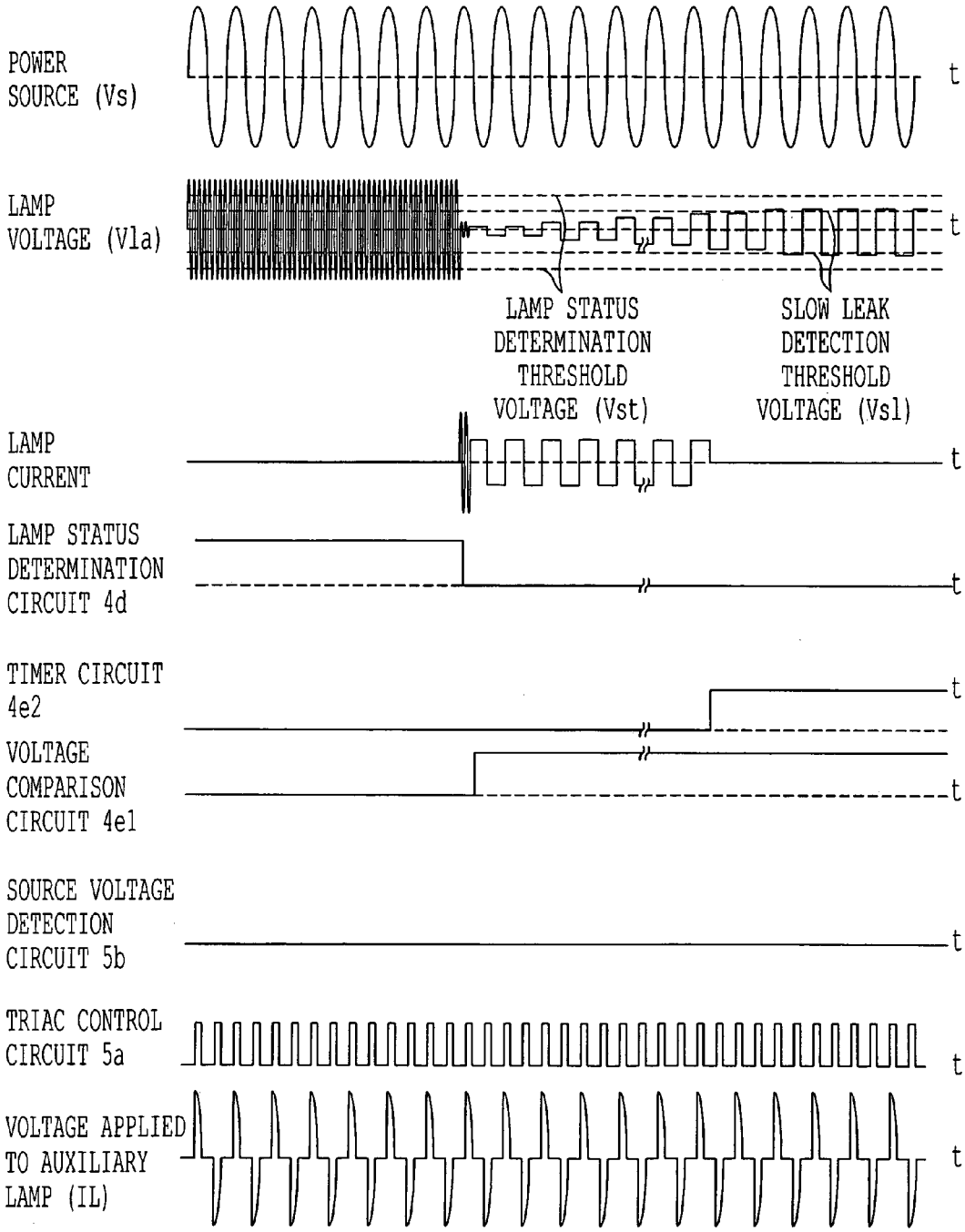
FIG. 4 is a sequence diagram showing an operation of the high-intensity discharge lamp ballast when there is a slow leak in the high-intensity discharge lamp.

Referring now to FIG. 4, the following will describe how the ballast 10 detects a slow leak in the HID lamp (La) and stops the power supply to the HID lamp (La). In this case, the source voltage (Vs) is higher than the rated voltage of the auxiliary lamp (IL), and thus the operation of the ballast 10 is similar to its operation shown in FIG. 3 until the HID lamp (La) starts its operation. Once the HID lamp (La) is turned on, the slow leak detection circuit 4*e* starts examining whether there is a slow leak in the HID lamp (La) by measuring the time at the timer circuit 4*e*2 and comparing the detected lamp voltage (Vla) with the threshold voltage (Vsl). In the case of FIG. 4, due to the slow leak in the HID lamp (La), the lamp voltage (Vla) does not reach the threshold voltage (Vsl). When the time measured by the timer circuit 4*e*2 exceeds the predetermined length of time and the detected lamp voltage (Vla) is still lower than the threshold voltage (Vsl), the slow leak detection circuit 4*e* determines that there is a slow leak in the HID lamp (La) and switches its output from the L signal to the H signal. The switching circuit 4*f*2 receives this H signal and turns off the buck converter 2 to stop the power supply to the HID Lamp (La). When the buck converter 2 stops supplying the power to the HID lamp (La), the lamp voltage (Vla) becomes substantially equal to zero. The voltage comparison circuit 4*e*1 continues to output the H signal to the OR circuit 6, and thus the TRIAC control circuit 5*a* supplies the pulse to the TRIAC (Q51) to turn on the TRIAC (Q51). As a result, the auxiliary lamp (IL) remains turned on, receiving the effective voltage substantially equal to the rated voltage of the auxiliary lamp (IL) produced by the phase control of the source voltage (Vs).

Figure 5A:
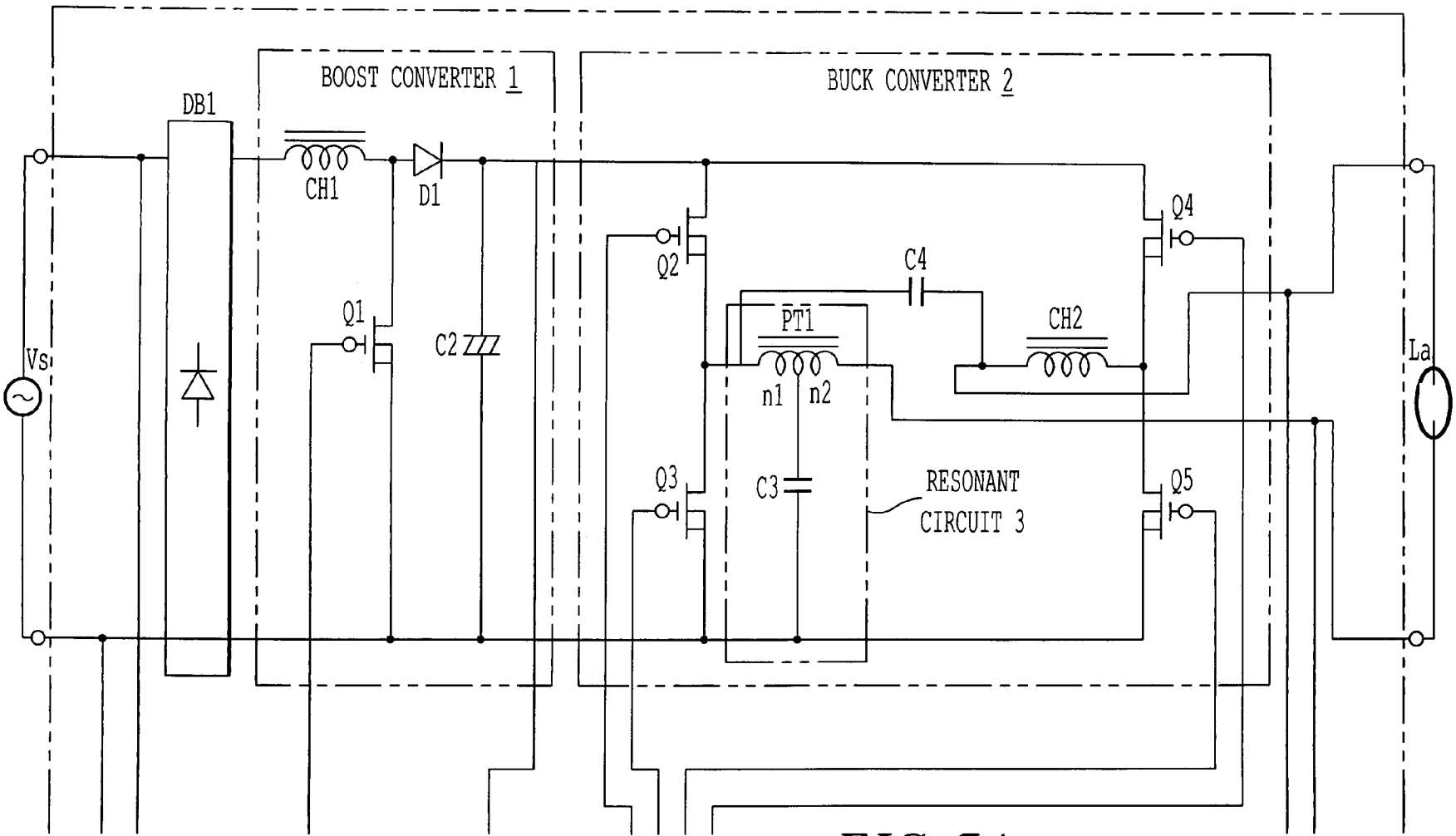
FIGS. 5(*a*) and 5(*b*) are schematic block diagrams illustrating a high-intensity discharge lamp ballast according to a second embodiment of the present invention.
Figure 5B:
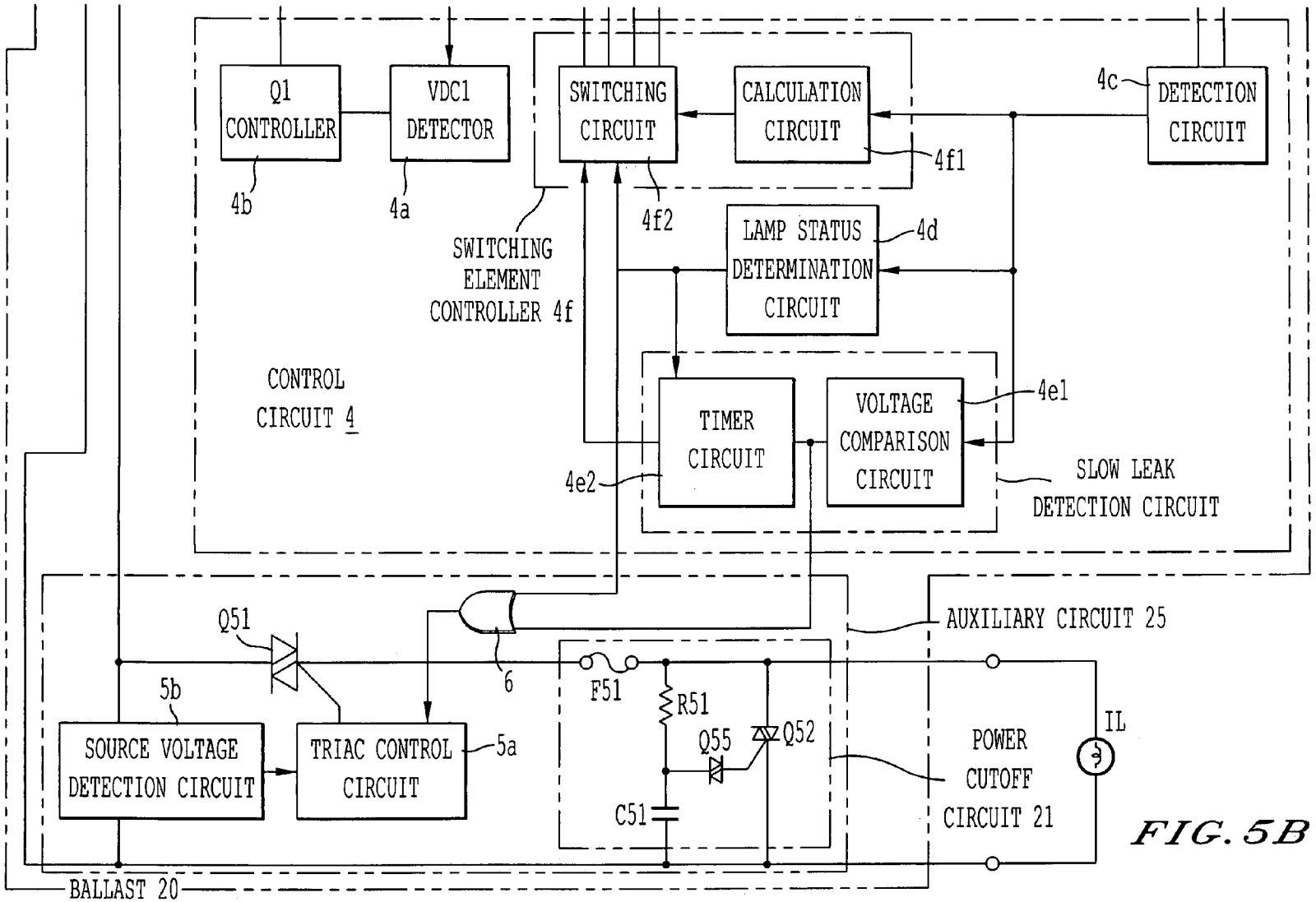

FIGS. 5(*a*) and 5(*b*) are block diagrams illustrating a high-intensity discharge lamp ballast according to a second embodiment of the present invention. A high-intensity discharge lamp ballast 20 (hereinafter, simply referred to as "ballast 20") includes an auxiliary circuit 25 having a similar structure to the aforementioned auxiliary circuit 5 of the ballast 10 except for a power cutoff circuit 21. The power cutoff circuit 21 (power cutoff unit) has a fuse (F51) (disconnection unit), a TRIAC (Q52), a resistor (R51), a capacitor (C51) and a voltage sensitive bidirectional switch (hereinafter, simply referred to as "switch") (Q55). The resistor (R51) and the capacitor (C51) serve as an auxiliary lamp voltage detector. The fuse (F51) is positioned between the auxiliary lamp (IL) and the TRIAC (Q51), and the TRIAC (Q52) is positioned between the fuse (F51) and the auxiliary lamp (IL) in parallel with the auxiliary lamp (IL). The resistor (R51), the capacitor (C51) and the switch (Q55) are provided as a control circuit of the TRIAC (Q52). Since the auxiliary circuit 25 has such a structure as in the present embodiment, even if an excessively high voltage is produced by a malfunction of the TRIAC (Q51) or by source voltage anomalies, and the high voltage is applied to the auxiliary lamp (IL), the auxiliary circuit 25 stops supplying power to the auxiliary lamp (IL) and prevents the auxiliary lamp (IL) from being destroyed by the high voltage.

Figure 6:
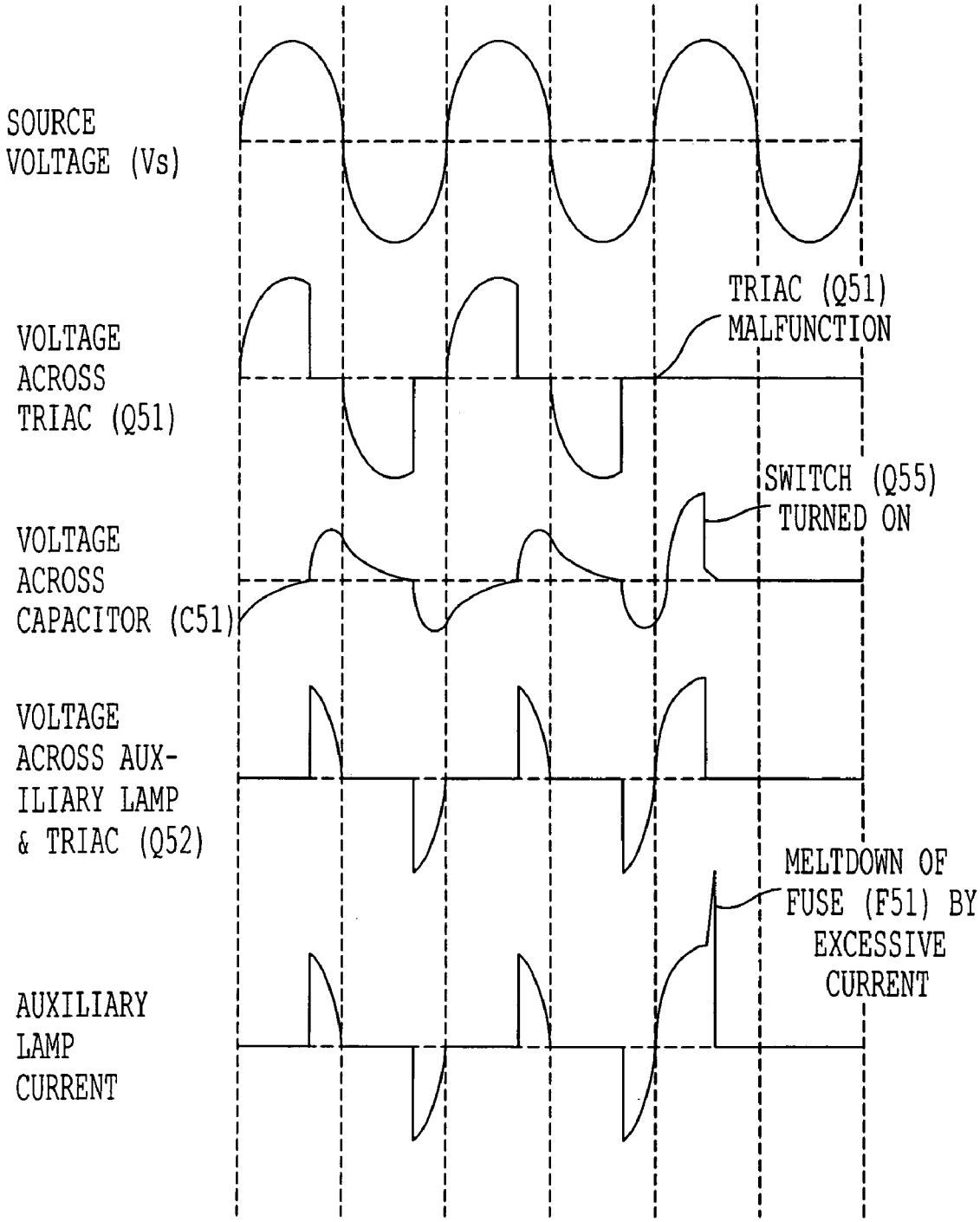
FIG. 6 is a sequence diagram showing an operation of the high-intensity discharge lamp ballast shown in FIGS. 5(*a*) and 5(*b*)

Referring to FIG. 6, the following will describe how the auxiliary circuit 25 stops the power supply to the auxiliary lamp (IL) in case of the malfunction of the TRIAC (Q51). When the source voltage (Vs) of the power source is significantly higher than the rated voltage of the auxiliary lamp (IL) and a short circuit occurs in the TRIAC (Q51), the source voltage (Vs) is not properly phase-controlled, and thus an excessively high voltage is applied to the auxiliary lamp (IL). In the case of FIG. 6, the TRIAC (Q51) at first operates properly but later malfunctions, and thus the charge time of the capacitor (C51) becomes longer and the capacitor voltage during the charge becomes higher than when the TRIAC (Q51) operates without a malfunction. In the ballast 20 according to this embodiment of the present invention, the response voltage of the switch (Q55) is set so that the response voltage is higher than the voltage charged to the capacitor (C51) when the TRIAC (Q51) operates properly, but lower than the voltage charged to the capacitor (C51) when the TRIAC (Q51) is short-circuited. Thus, when the TRIAC (Q51) has a short circuit, the switch (Q55) is turned on, and the current flows into the gate terminal of the TRIAC (Q52), which short-circuits both ends of the auxiliary lamp (IL). Due to the short circuit, an excessively large current is supplied from the power source to the auxiliary circuit 25, the fuse (F51) is melt down, and thus the power supply to the auxiliary lamp (IL) is stopped. Accordingly, the ballast 20 of the present embodiment more effectively prevents the auxiliary lamp (IL) from being broken down. However, in an auxiliary circuit where such a preventive control is unavailable, the breakdown of the auxiliary lamp may not be avoided, and thus it would be highly dangerous, especially in the case where a halogen lamp is used as the auxiliary lamp.

Figure 7A:
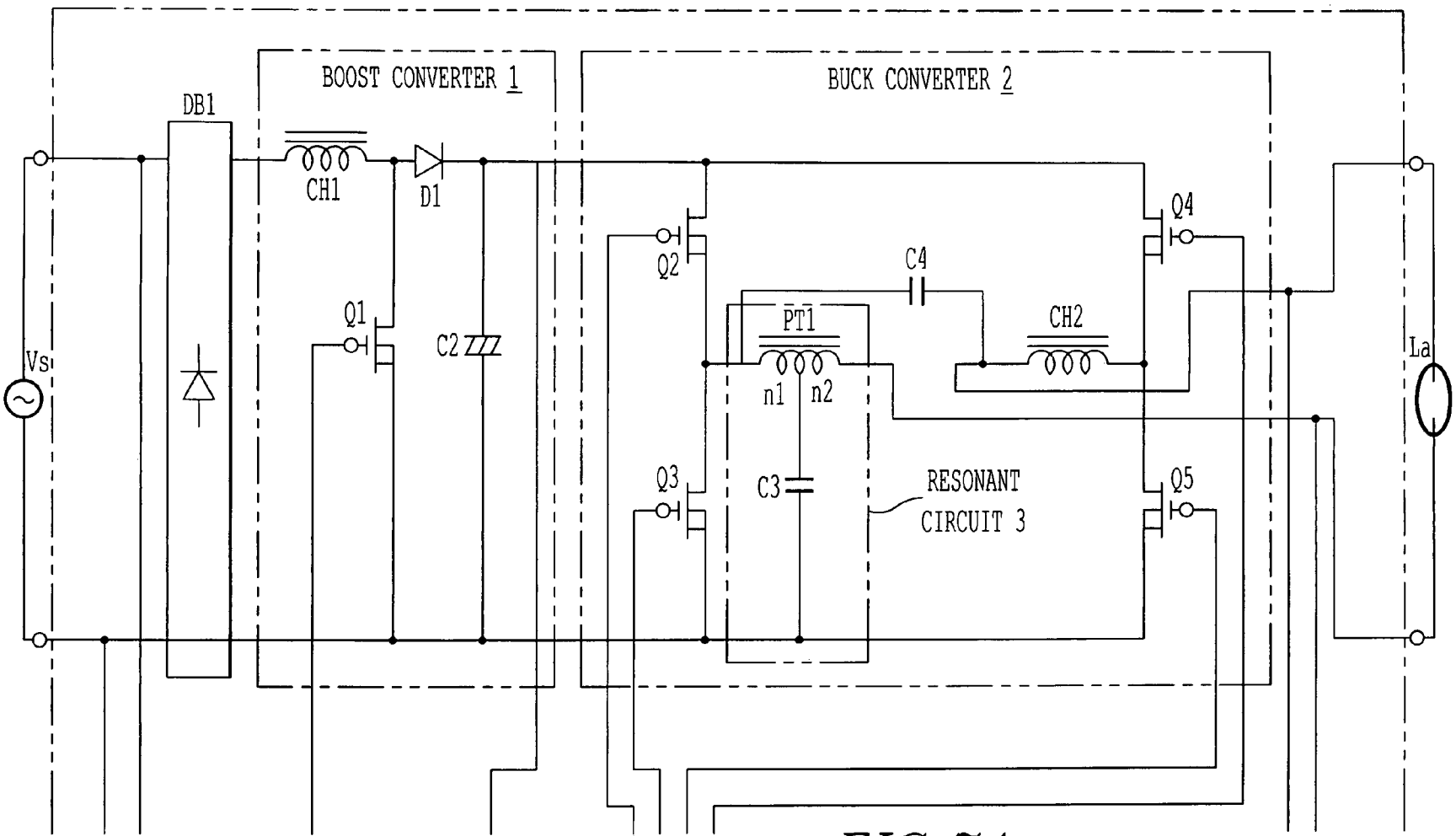
FIGS. 7(*a*) and 7(*b*) are schematic block diagrams illustrating a high-intensity discharge lamp ballast according to a third embodiment of the present invention.
Figure 7B:
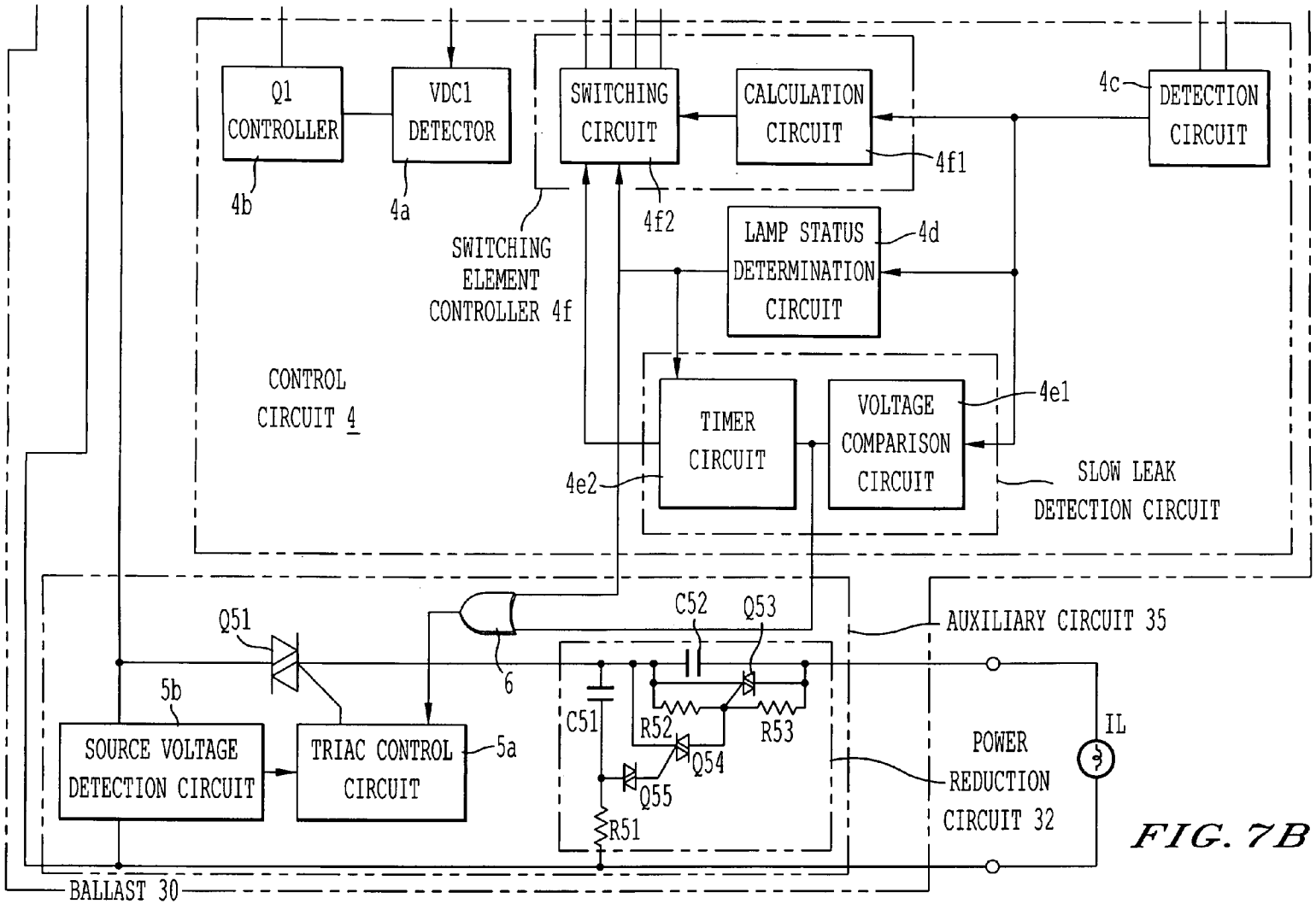

FIGS. 7(*a*) and 7(*b*) are block diagrams showing a high-intensity discharge lamp ballast according to a third embodiment of the present invention. A high-intensity discharge lamp ballast 30 (hereinafter, simply referred to as "ballast 30") has an auxiliary circuit 35 having a similar structure to the aforementioned auxiliary circuit 25 of the ballast 20 except for a power reduction circuit 32. The power reduction circuit 32 (power reduction unit) has capacitors (C51) and (C52), a TRIAC (Q53), resistors (R51), (R52) and (R53), a TRIAC (Q54) and a voltage sensitive bidirectional switch (hereinafter, simply referred to as "switch") (Q55). The resistor (R51) and the capacitor (C51) serve as an auxiliary lamp voltage detector. The capacitor (C52) is positioned between the auxiliary lamp (IL) and the TRIAC (Q51), and the TRIAC (Q53) is positioned so as to connect/disconnect both ends of the capacitor (C52). The resistors (R52) and (R53), and the TRIAC (Q54) are provided as a control circuit of the TRIAC (Q53). Also, the resistor (R51), the capacitor (C51) and the switch (Q55) are provided as a control circuit of the TRIAC (Q54). Since the auxiliary circuit 35 has such a structure as in the present embodiment, even if an excessively high voltage is produced by a malfunction of the TRIAC (Q51) or by source voltage anomalies, and the high voltage is applied to the auxiliary lamp (IL), the power reduction circuit 32 reduces the power supplied to the auxiliary lamp (IL) and prevents the auxiliary lamp (IL) from being destroyed by the high voltage.

Figure 8:
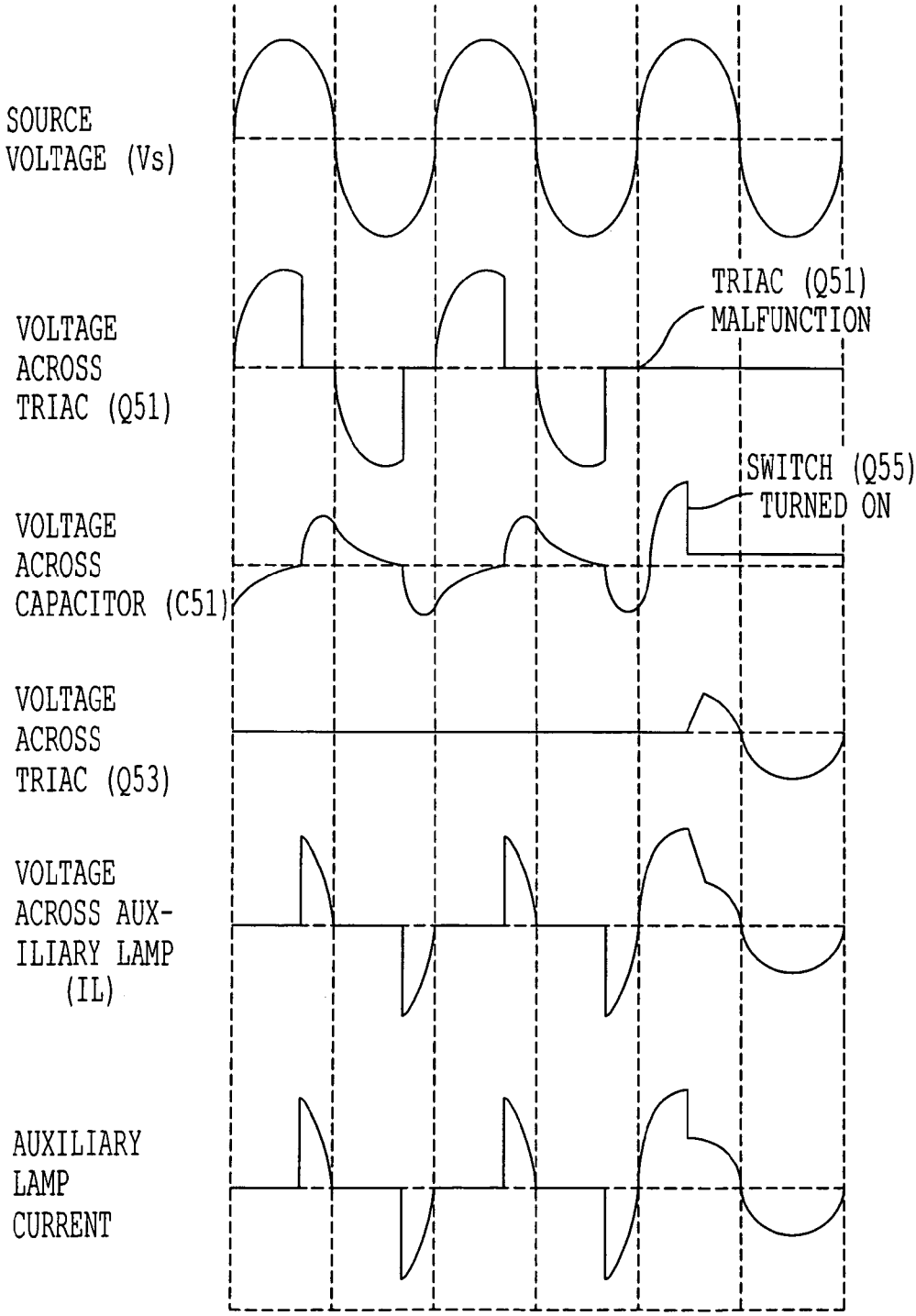
FIG. 8 is a sequence diagram showing an operation of the high-intensity discharge lamp ballast shown in FIGS. 7(*a*) and 7(*b*)

Referring now to FIG. 8, the following will describe how the power reduction circuit 32 reduces the power supplied to the auxiliary lamp (IL) in case of the malfunction of the TRIAC (Q51). When the source voltage (Vs) of the power source is significantly higher than the rated voltage of the auxiliary lamp (IL) and a short circuit occurs in the TRIAC (Q51), the source voltage (Vs) is not properly phase-controlled, and thus an excessively high voltage is applied to the auxiliary lamp (IL). In the case of FIG. 8, the TRIAC (Q51) at first operates properly, and thus the TRIAC (Q53) is turned on and a phase-controlled voltage is applied to the auxiliary lamp (IL). However, when the TRIAC (Q51) is short-circuited and malfunctions, since the TRIAC (Q53) is turned on, a high voltage substantially equal to the source voltage (Vs) is supplied to the auxiliary lamp (IL). As a result, the charge time of the capacitor (C51) becomes longer and the capacitor voltage during the charge becomes higher than when the TRIAC (Q51) operates without a malfunction. The response voltage of the switch (Q55) is set so that the response voltage is higher than the capacitor charge voltage when the TRIAC (Q51) operates properly, but lower than the capacitor charge voltage when the TRIAC (Q51) is short-circuited. Thus, when the TRIAC (Q51) has a short circuit, the switch (Q55) is turned on, and the current flows into the gate terminal of the TRIAC (Q54) and turns on the TRIAC (Q54). The gate terminal of the TRIAC (Q53) is short-circuited, and the trigger current does not flow into the gate terminal. Thus, the TRIAC (Q53) is turned off. As a result, the capacitor (C52) is inserted between the TRIAC (Q51) and the auxiliary lamp (IL), and the source voltage (Vs) is divided by the impedance of the capacitor (C52) and the auxiliary lamp (IL). Hence, a reduced voltage is applied to the auxiliary lamp (IL). In this manner, the auxiliary circuit 35 of the ballast 30 more effectively prevents the application of an excessively high voltage to the auxiliary lamp (IL) which would otherwise adversely affect the operation of the auxiliary lamp (IL).

Figure 9:
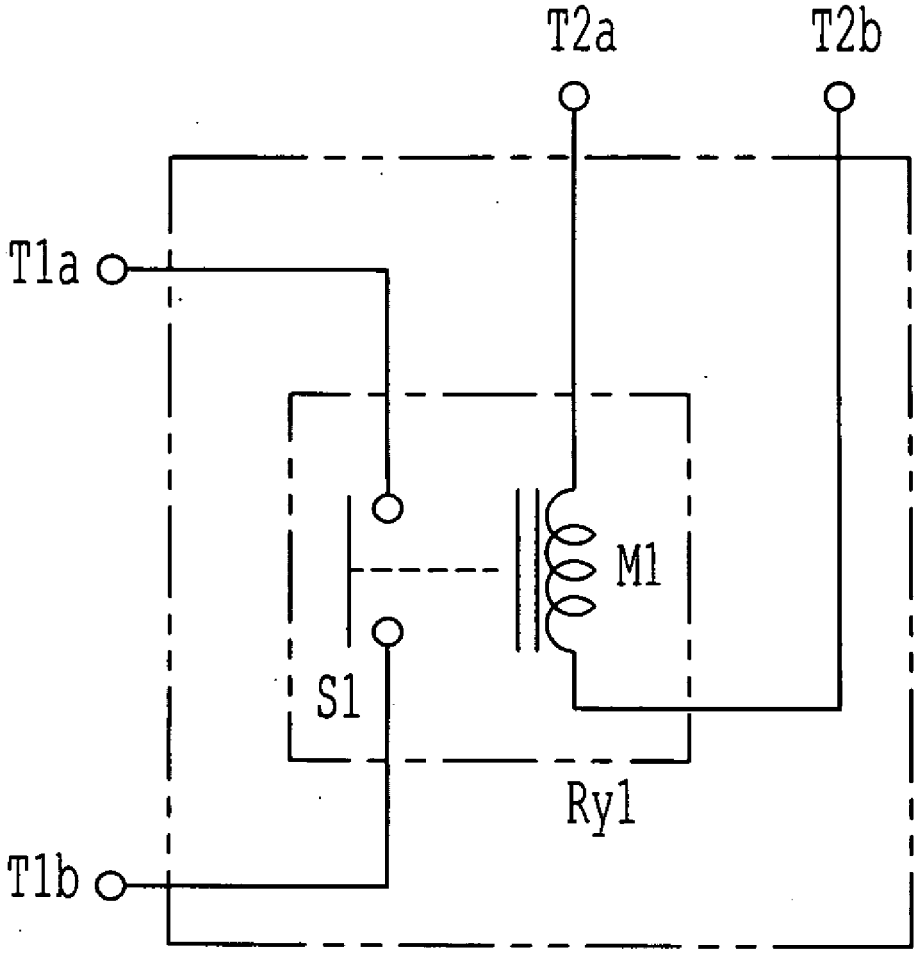
FIG. 9 is a schematic diagram illustrating a relay circuit for an auxiliary lighting device.
Figure 10A:
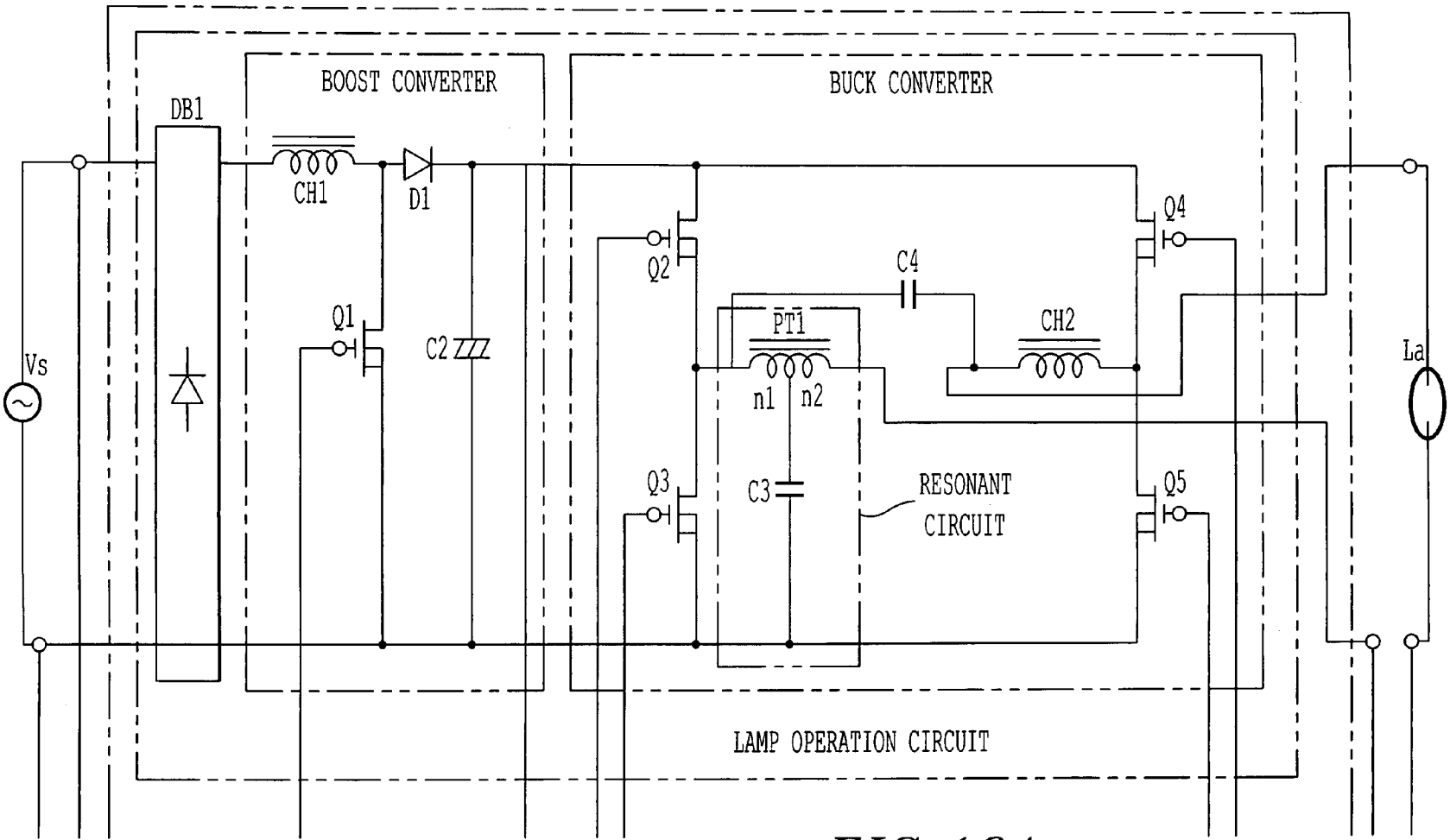
FIGS. 10(*a*) and 10(*b*) are schematic block diagrams illustrating an auxiliary lighting device having the relay circuit.
Figure 10B:
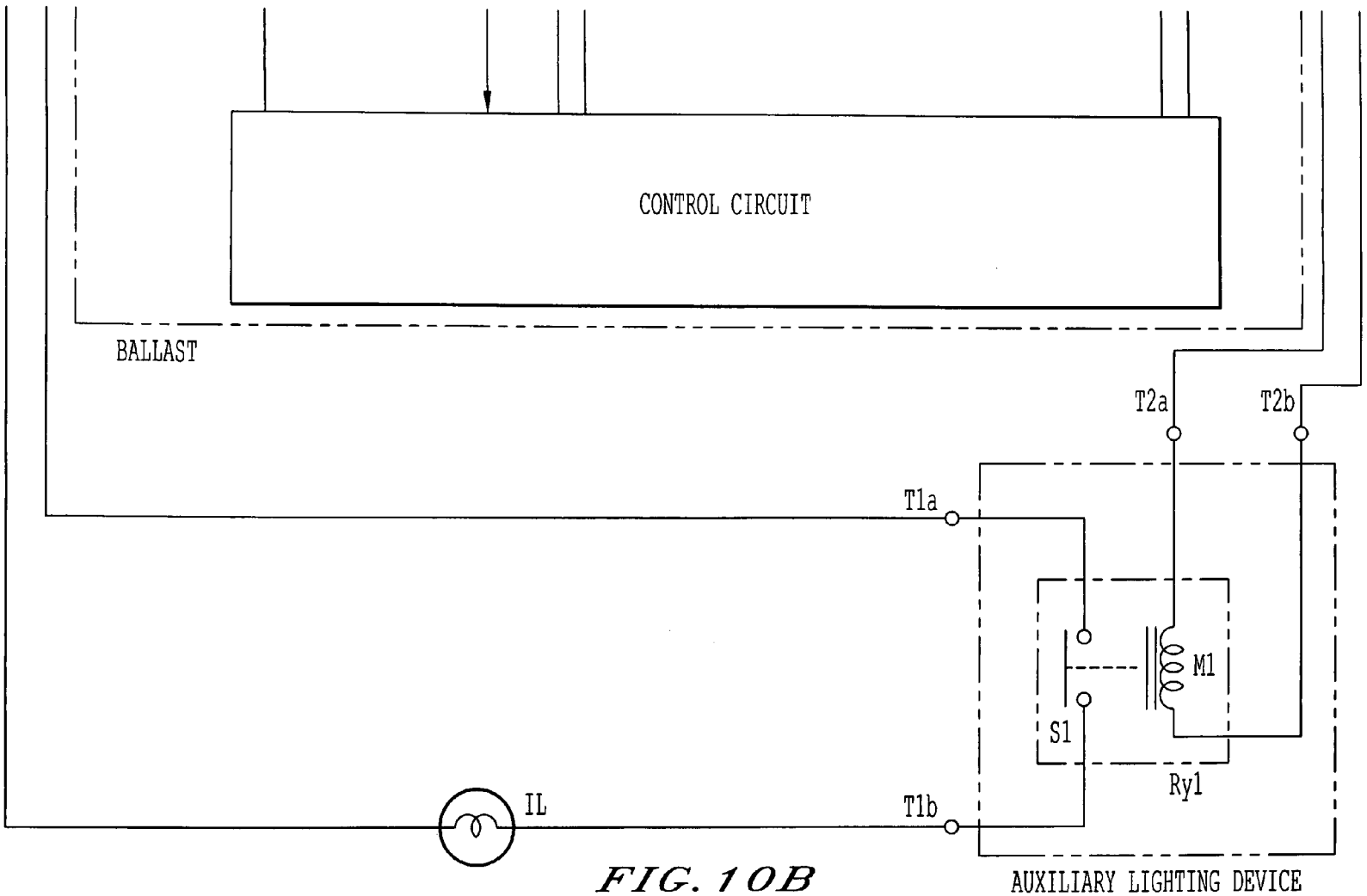
Figure 11A:
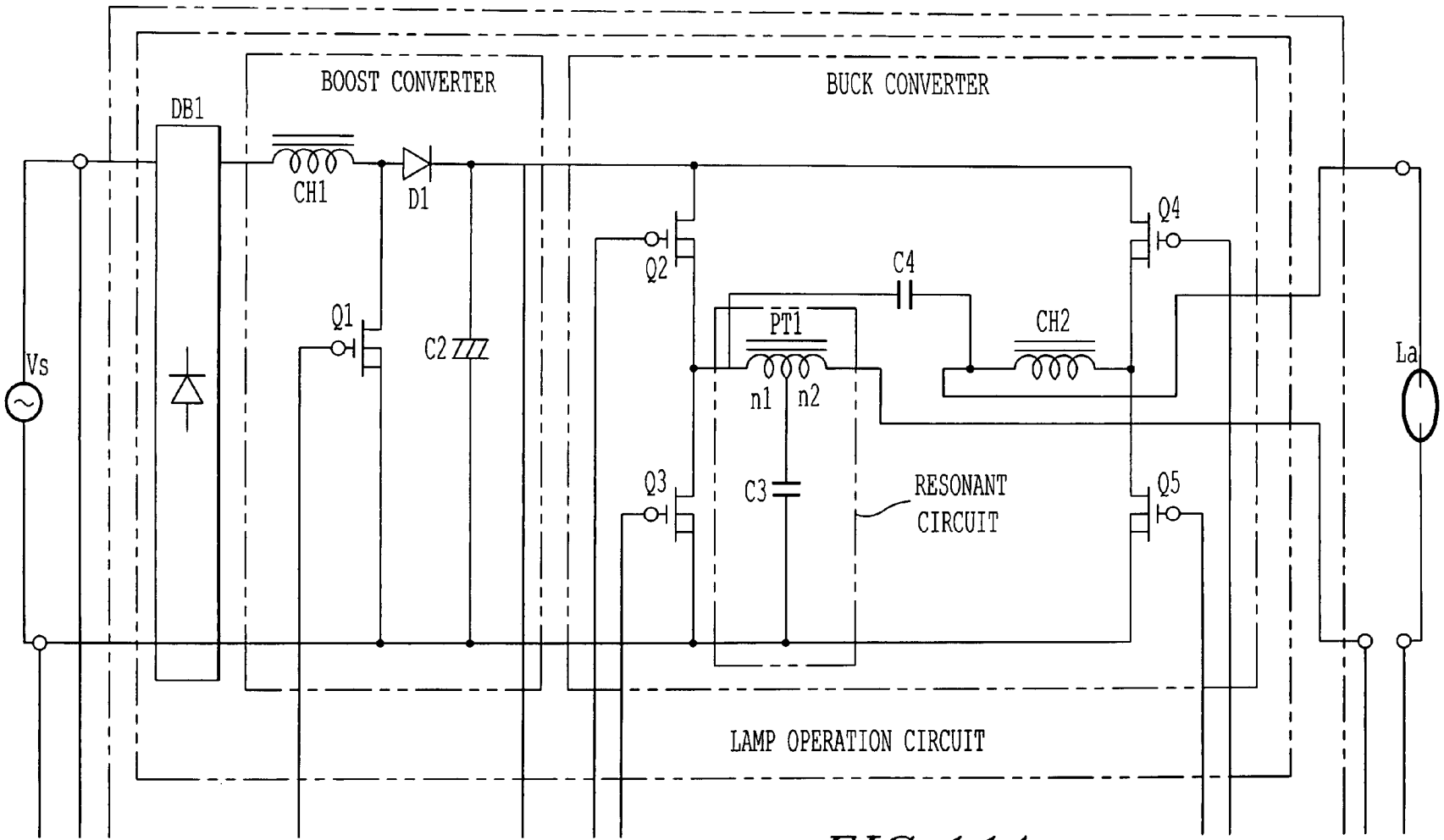
FIGS. 11(*a*) and 11(*b*) are schematic block diagrams illustrating an auxiliary lighting device having the relay circuit and a transformer.
Figure 11B:
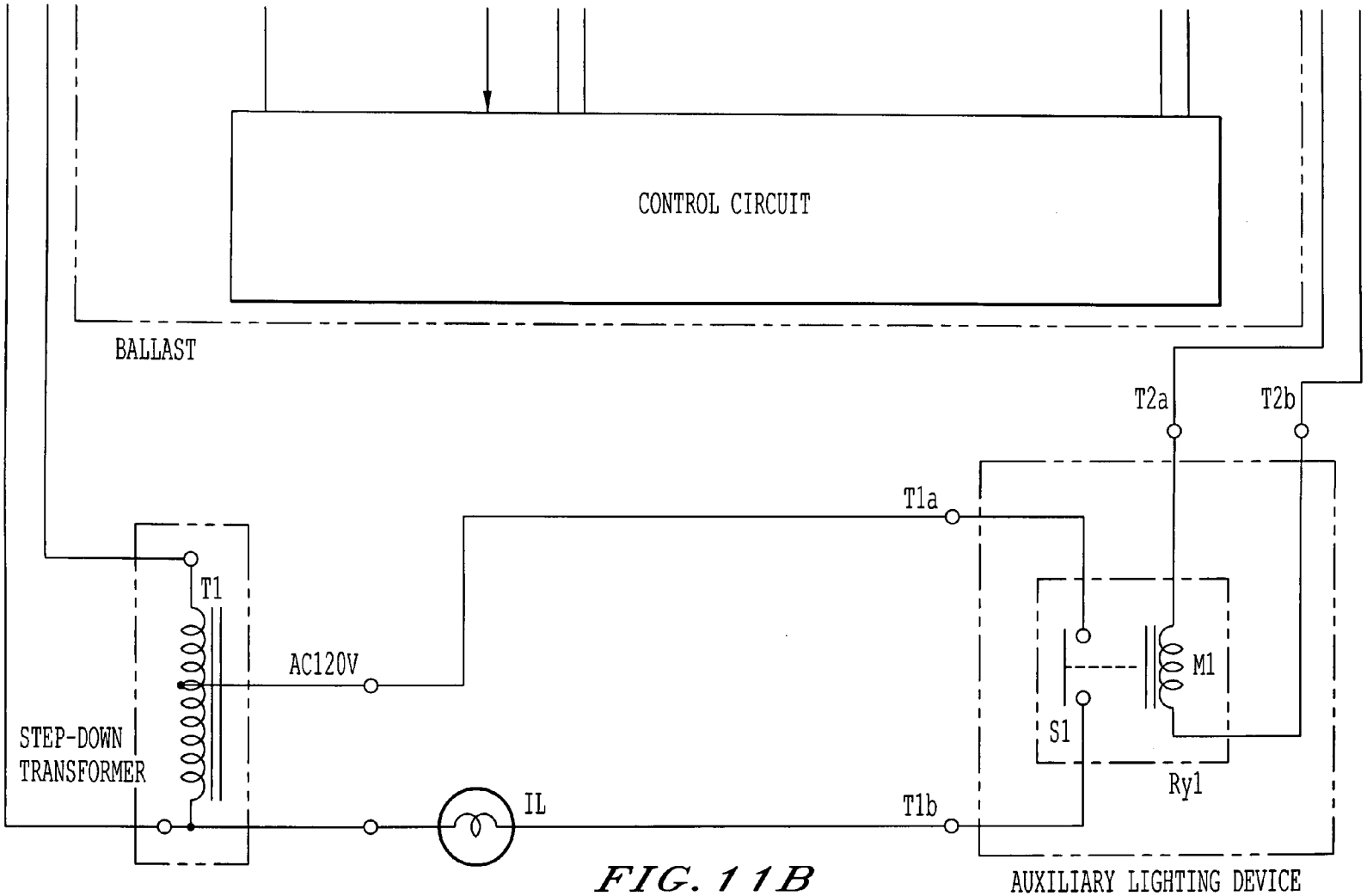
Figure 4:
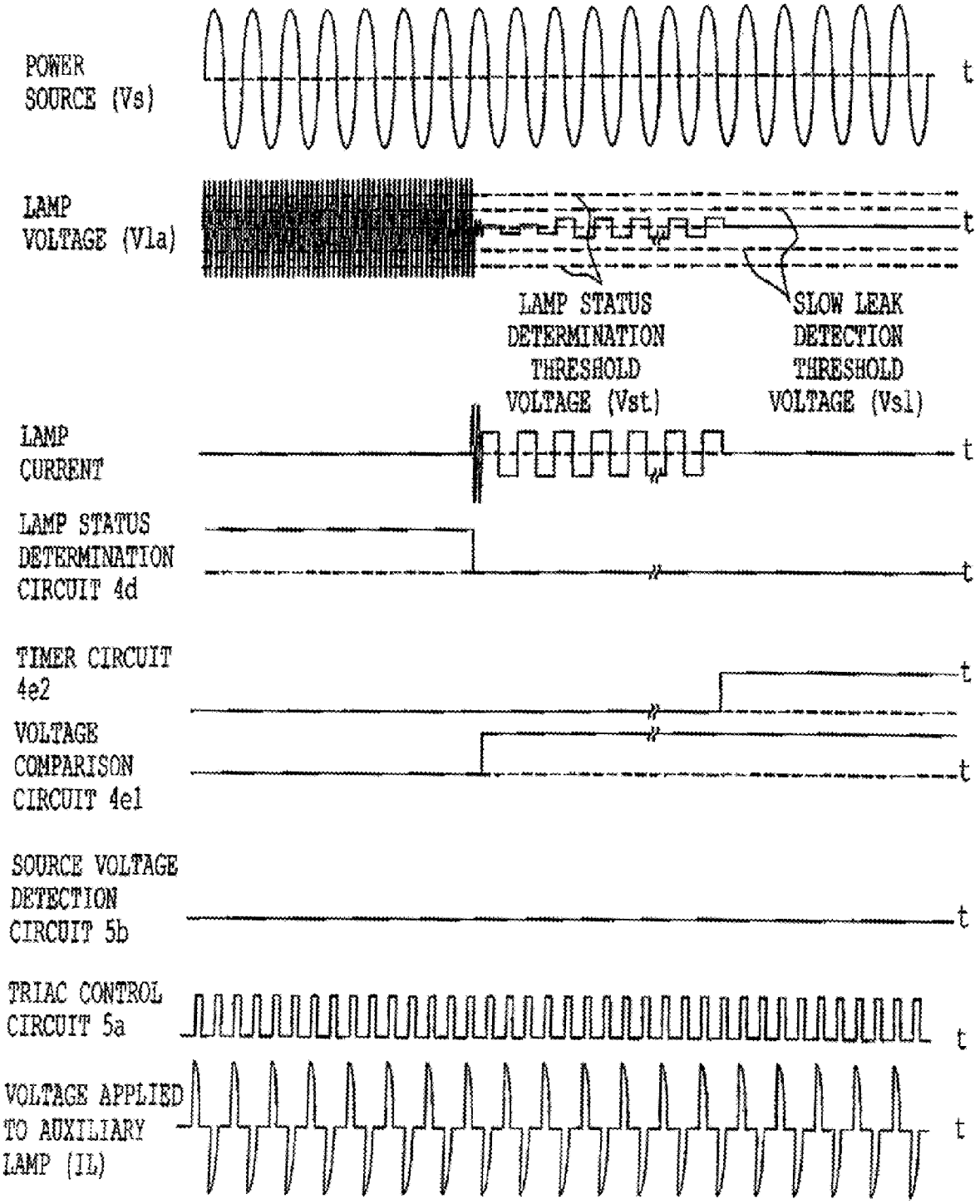

As described above, in the ballast according to the embodiment of the present invention, the TRIAC controller controls the TRIAC so as to apply to the auxiliary lamp a voltage substantially equal to the rated voltage of the auxiliary lamp when the HID lamp is supplied with the power and the lamp status determination circuit determines that the HID lamp is not in the turned-on state. Hence, the ballast properly turns on the auxiliary lamp with the voltage substantially equal to the rated voltage, regardless of the voltage of the power source. Accordingly, unlike the situation in which ballasts are designed differently depending on the source voltage of the power source, the inventory control of the ballast according to the embodiment of the present invention is much easier, and the productivity is significantly increased. However, in the case of the auxiliary lighting device as shown in FIGS. 9, 10(*a*) and 10(*b*), the device is compatible only with a selected voltage. More specifically, the auxiliary lighting device shown in FIGS. 10(*a*) and 10(*b*) has a relay circuit (Ry1), a pair of terminals (T1*a*) and (T1*b*) connected between a power source and an incandescent lamp, and a pair of terminals (T2*a*) and (T2*b*) connected between an HID lamp and a ballast. An excitation wire (M1) is connected between the terminals (T2*a*) and (T2*b*), and a main switch (S1) between the terminals (T1*a*) and (T1*b*). In the relay circuit (Ry1), when a current flows through the excitation wire (M1), the main switch (S1) is turned off, while no current flows, the main switch (S1) is turned on. When the high-intensity discharge lamp is turned off, since no current flows through the excitation wire (M1), the main switch (S1) is turned on, and the incandescent lamp receives power from the power source. Once the high-intensity discharge lamp is turned on and the current flows through the excitation wire (M1), the main switch (S1) is turned off, and thus the power supply to the incandescent lamp is stopped, and the incandescent lamp is turned off. However, as shown in FIGS. 11(*a*) and 11(*b*), the auxiliary lighting device requires a transformer for decreasing the source voltage (AC 277 V) to the rated voltage (AC 120V) of the incandescent lamp. In contrast, the ballast according to the embodiment of the present invention has a controller configured to control the TRIAC so as to apply to the auxiliary lamp a voltage substantially equal to the rated voltage of the auxiliary lamp when the lamp status determination circuit determines that the HID lamp is turned off, and thus the ballast has a smaller and less complicated structure.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high-intensity discharge lamp ballast comprising:

a lamp operation unit configured to supply power from a power source to a high-intensity discharge lamp;

a lamp voltage detector configured to detect a voltage applied to the high-intensity discharge lamp;

a lamp status determination unit configured to determine whether the high-intensity discharge lamp is in a turned-on state, based on the voltage detected by the lamp voltage detector;

an auxiliary lamp switching element configured to connect the power source and an auxiliary lamp having a rated voltage; and a controller configured to control the auxiliary lamp switching element so as to apply to the auxiliary lamp a voltage substantially equal to the rated voltage of the auxiliary lamp when the high-intensity discharge lamp is supplied with the power and the lamp status determination unit determines that the high-intensity discharge lamp is not in the turned-on state.

2. The ballast of claim 1, wherein the auxiliary switching element comprises a bidirectional gate-controlled switching element.

3. The ballast of claim 1, wherein the controller applies to the auxiliary lamp the voltage substantially equal to the rated voltage of the auxiliary lamp when the lamp operation unit supplies the power to the high-intensity discharge lamp in a starter power mode for starting an operation of the high-intensity discharge lamp.

4. The ballast of claim 1, further comprising a slow leak detector configured to determine whether there is a slow leak in the high-intensity discharge lamp based on the voltage detected by the lamp voltage detector, wherein the controller turns on the auxiliary lamp switching element when the slow leak detector determines that there is a slow leak in the high-intensity discharge lamp.

5. The ballast of claim 4, wherein the controller controls the auxiliary lamp switching element not to apply a voltage to the auxiliary lamp when the lamp status determination unit determines that the high-intensity discharge lamp is in the turned-on state and when the slow leak detector determines that there is no slow leak in the high-intensity discharge lamp.

6. The ballast of claim 4, wherein:

the slow leak detector includes a lamp voltage comparator configured to compare the voltage detected by the lamp voltage detector to a threshold value, and a timer configured to measure a time when the voltage is lower than the threshold value, starting from a time when the high-intensity discharge lamp begins operating;

the slow leak detector determines that there is a slow leak in the high-intensity discharge lamp, when the time measured by the timer exceeds a predetermined reference length of time; and the controller applies to the auxiliary lamp the voltage substantially equal to the rated voltage of the auxiliary lamp while the timer measures the time.

7. The ballast of claim 1, further comprising a power reduction unit configured to reduce power supplied to the auxiliary lamp.

8. The ballast of claim 7, wherein the power reduction unit includes:

an auxiliary lamp voltage detector configured to detect a voltage applied to the auxiliary lamp;

an impedance element positioned between the power source and the auxiliary lamp; and a switching element connected in parallel with the impedance element and configured to be turned off when the voltage detected by the auxiliary lamp voltage detector is higher than a predetermined threshold.

9. The ballast of claim 8, wherein the predetermined threshold is an allowable maximum voltage of the auxiliary lamp.

10. The ballast of claim 1, further comprising a power cutoff unit configured to stop a power supply from the power source to the auxiliary lamp.

11. The ballast of claim 10, wherein the power cutoff unit includes:

an auxiliary lamp voltage detector configured to detect a voltage applied to the auxiliary lamp;

a switching element connected in parallel with the auxiliary lamp and configured to be turned on when the voltage detected by the auxiliary lamp voltage detector is higher than a predetermined threshold; and a disconnection unit connected in series with the switching element and the auxiliary lamp and configured to disconnect the auxiliary lamp from the power source when the switching element is turned on.

12. The ballast of claim 11, wherein the disconnection unit comprises a fuse.

13. The ballast of claim 11, wherein the predetermined threshold is an allowable maximum voltage of the auxiliary lamp.

14. The ballast of claim 1, further comprising a source voltage detector configured to detect a source voltage of the power source, and a voltage comparison unit configured to compare the source voltage detected by the source voltage detector to a predetermined reference voltage, wherein, when the voltage comparison unit determines that the source voltage is higher than the predetermined reference voltage, the controller applies to the auxiliary lamp the voltage produced by a phase control of the source voltage which decreases the source voltage to substantially equal to the rated voltage of the auxiliary lamp.

15. The ballast of claim 14, wherein the predetermined reference voltage is an allowable maximum voltage of the auxiliary lamp.

16. The ballast of claim 14, wherein the controller forms a pulse of a fixed width when the voltage comparison unit determines that the source voltage is higher than the predetermined reference voltage, and a DC signal when the voltage comparison unit determines that the source voltage is not higher than the predetermined reference voltage.

17. The ballast of claim 14, wherein the predetermined reference voltage is an allowable maximum voltage of the power source having a source voltage substantially equal to the rated voltage of the auxiliary lamp.

18. The ballast of claim 17, wherein the predetermined reference voltage is about 10% larger than the source voltage substantially equal to the rated voltage of the auxiliary lamp.

19. A high-intensity discharge lamp ballast comprising:

lamp operation means for supplying power from a power source to a high-intensity discharge lamp;

lamp voltage detection means for detecting a voltage applied to the high-intensity discharge lamp;

lamp status determination means for determining whether the high-intensity discharge lamp is in a turned-on state, based on the voltage detected by the lamp voltage detection means;

auxiliary lamp switching means for connecting the power source and an auxiliary lamp having a rated voltage; and control means for controlling the auxiliary lamp switching means so as to apply to the auxiliary lamp a voltage substantially equal to the rated voltage of the auxiliary lamp when the high-intensity discharge lamp is supplied with the power and the lamp status determination means determines that the high-intensity discharge lamp is not in the turned-on state.

20. A method for operating a high-intensity discharge lamp, comprising:

supplying power from a power source to the high-intensity discharge lamp;

detecting a voltage applied to the high-intensity discharge lamp;

determining whether the high-intensity discharge lamp is in a turned-on state, based on a detected voltage;

providing an auxiliary lamp switching element configured to connect the power source and an auxiliary lamp having a rated voltage; and controlling the auxiliary lamp switching element so as to apply to the auxiliary lamp a voltage substantially equal to the rated voltage of the auxiliary lamp when the high-intensity discharge lamp is supplied with the power and the high-intensity discharge lamp is not determined to be in the turned-on state.

* * * * *

UNITED STATES PATENT AND TRADEMARK OFFICE

CERTIFICATE OF CORRECTION

PATENT NO. : 7,109,659 B2
APPLICATION NO. : 10/991415
DATED : September 19, 2006
INVENTOR(S) : Takeshi Kamoi It is certified that error appears in the above-identified patent and that said Letters Patent is hereby corrected as shown below:

Please replace Fig. 4 with the corrected Fig. 4 attached herewith.

Signed and Sealed this

Twenty-sixth Day of August, 2008

JON W. DUDAS
*Director of the United States Patent and Trademark Office*